United States Patent [19]

LaFleur

[11] Patent Number: 4,781,475

[45] Date of Patent: Nov. 1, 1988

[54] REINFORCED BULK BAG

[75] Inventor: Lee LaFleur, Manistee, Mich.

[73] Assignee: Custom Packaging Systems, Inc., Manistee, Mich.

[21] Appl. No.: 119,109

[22] Filed: Nov. 10, 1987

[51] Int. Cl.[4] ..... B65D 33/02

[52] U.S. Cl. ..... 383/119

[58] Field of Search ..... 383/119, 117, 118

[56] References Cited

U.S. PATENT DOCUMENTS 3,896,991 7/1975 Kozlowski et al. ..... 383/119

4,253,507 3/1981 Williamson ..... 383/119

*Primary Examiner*—Willis Little

*Attorney, Agent, or Firm*—Barnes, Kisselle, Raisch, Choate, Whittemore & Hulbert

[57] ABSTRACT

A bulk bag having a sidewall reinforced by a safety band. The safety band either encircles the sidewall or is disposed inside the bag. The safety band is located adjacent the bottom of the bag and preferably has a height equal to at least one-fifth of the height of the bag. The reinforced bulk bag is particularly suitable for transportation of hazardous materials.

18 Claims, 1 Drawing Sheet

FIG. 1
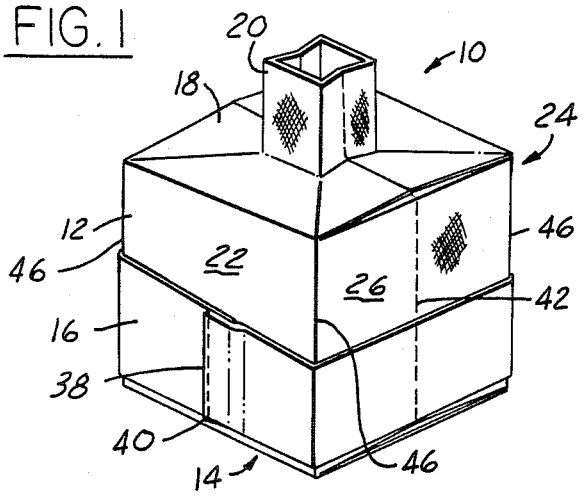
FIG. 2
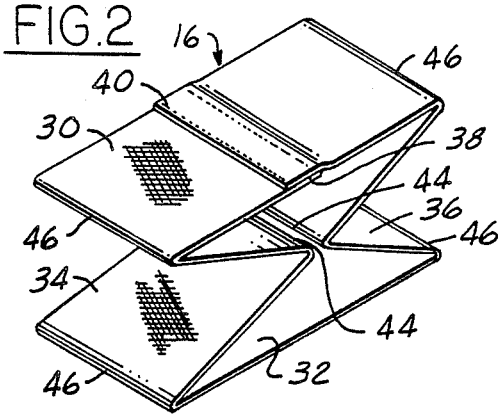
FIG. 3
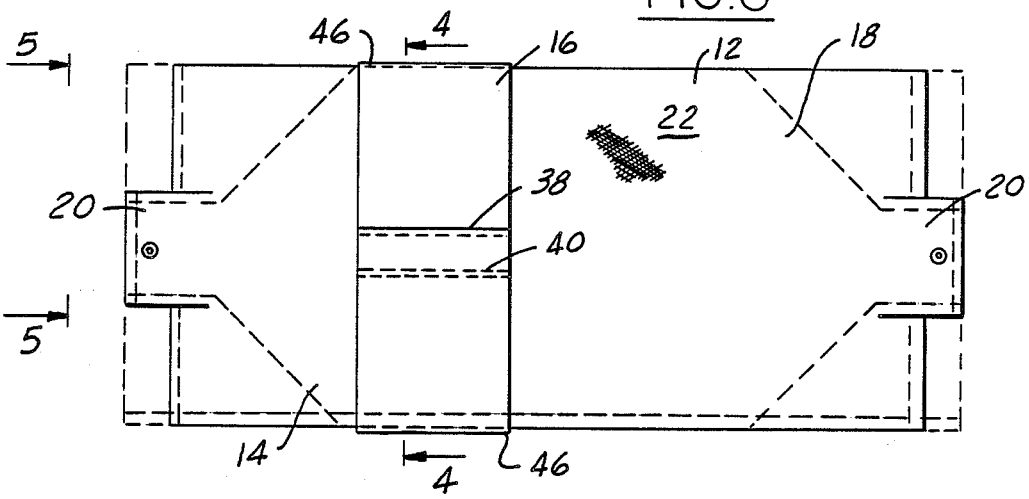
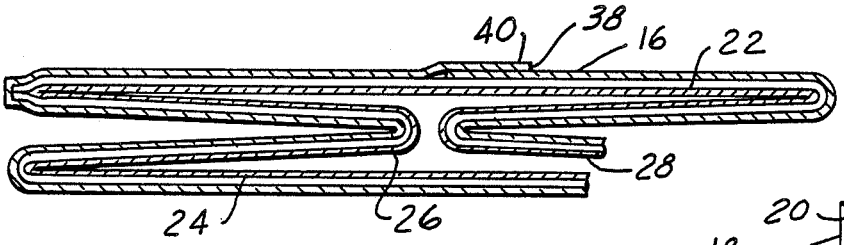
FIG. 4
FIG. 5
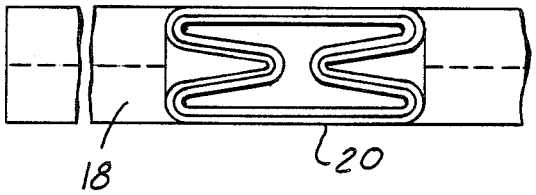
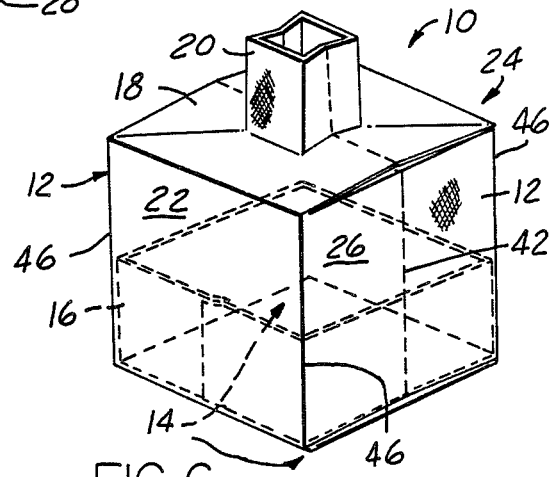
FIG. 6

REINFORCED BULK BAG

FIELD OF INVENTION

This invention relates to a bulk bag and more particularly to a bulk bag having sides reinforced by a safety band.

BACKGROUND OF THE INVENTION

Bulk bags previously used to transport both solid and liquid materials, particularly those of a hazardous nature, were unsatisfactory in that if accidently dropped they would often burst, thereby destroying the bags, and resulting in loss of their contents.

Consequently, the United States Department of Transportation has specified standard minimum requirements for transportation of hazardous materials in bulk bags. Such minimum standards require that a bag containing 2,200 pounds successfully survive a drop from a height of at least six feet without resulting in damage to the bag or spilling of its contents.

SUMMARY OF THE INVENTION

A bulk bag with a flexible sidewall reinforced by a flexible safety band. The band can either encircle the sidewall or be disposed therein so that the sidewall is reinforced. The safety band is located adjacent the bottom of the container or bag and preferably has a height equal to at least one-fifth of the height of the bag. Preferably, the safety band is tacked to the bag in at least two spaced apart locations. Preferably, the material of the bag alone, without the band, has insufficient strength to withstand being dropped six feet when full without bursting.

Objects, features and advantages of this invention are to provide a bag which when full will survive being dropped at least six feet without damaging the bag or loosing its contents, can be made of relatively lightweight and flexible material, has a high strength-to-weight ratio, and is of relatively simple design, extremely rugged, durable and of economical manufacture and assembly.

BRIEF DESCRIPTION OF THE DRAWINGS

These and other objects, feature and advantages of this invention will become apparent from the following detailed description, appended claims, and accompanying drawings in which:

FIG. 1 is a perspective view of a bag embodying this invention with a safety band encircling the bag;

FIG. 2 is an exploded perspective view of the safety band of FIG. 1 in a semi-expanded condition;

FIG. 3 is a plan view of the bag of FIG. 1 in a collapsed condition;

FIG. 4 is a fragmentary sectional view taken generally along line 4—4 of FIG. 3;

FIG. 5 is a fragmentary end view of the bag in the direction of the arrows 5—5 of FIG. 4; and FIG. 6 is a perspective view of another bag embodying this invention with the safety band disposed therein.

DETAILED DESCRIPTION

Referring to FIG. 1, a bulk bag 10 embodying this invention is constructed from a flexible material such as a woven fabric, preferably polypropylene or polyethylene, and has a sidewall 12, a bottom 14, and a safety band 16 encircling the sidewall or disposed in the bag such that the sidewall is reinforced. The safety band 16 is located adjacent the bottom of the bag and preferably has a vertical height ranging from one-fifth to one-half and preferably one-third to one-half of the height of the bag. Preferably, the safety band is tacked to the bag in at least two spaced apart locations. Preferably the bag has a top 18 and a spout 20 at one or both ends to facilitate charging and discharging its contents.

In a preferred construction, the bag is generally rectangular or cubical, and when empty collapsible into a generally flat configuration as shown in FIGS. 3 and 4. Preferably, the sidewall 12 is formed with two opposed flat panels 22, 24 and two opposed gusset panels 26, 28 such that the bag assumes a generally rectangular shape when filled and when empty is easily collapsed into a flat unit for shipping and storage before being filled.

The construction and arrangement of the preferred bag or container 10 is fully disclosed in U.S. Pat. No. 4,596,040, the disclosure of which is incorporated herein by reference and hence will not be described in further detail.

The safety band 16 is constructed of a flexible material such as a woven fabric, preferably polypropylene or polyethylene. To conform to the bag, the safety band has a pair of opposed flat panels 30, 32 and a pair of opposed gusset panels 34, 36 (FIG. 2). The band may be made from a circumferentially continuous piece of material or from a strip of material having two ends 38 secured together such as by stitches 40 in an overlapping manner so as to form a single continuous band. Preferably, the overlapped ends are located in one of the opposed flat panels of the band so the gusset panels of the band can fold easily inward without being obstructed by the overlapped ends. Similarly, the band is tacked to the bag so its overlapped ends are located on one of the opposed flat panels 22 or 24 of the bag so its gusset panels can fold easily inward without being obstructed by the overlapped band ends. The overlapped band ends should be located in a spaced apart relationship to any seam in the container or bag and preferably in a generally opposed position to any such seam.

Preferably, the safety band is outside of and encircles the sidewall of the bag as shown in FIG. 1. Preferably, the band is tacked to the bag closely adjacent the folds 42 of the gusset panels, as indicated at points 44 (FIG. 2) so the band will fold inward easily along with the gusset panels of the bag to a flat condition.

As shown in FIG. 6, the safety band may be disposed inside the collapsible bulk bag. With this arrangement, the safety band is tacked to the bag closely adjacent at least each of its vertical corners such as by stitches at the points 46. This insures the safety band will remain closely adjacent each panel when the bag is folded into a flat condition.

Preferably, when the bag is expanded each side has a nominal width in the range of about 28 to 44 inches and nominal vertical height in a range of about 36 to 54 inches. Preferably, the band has a nominal vertical height of about one-fifth to one-half and usually about one-third to one-half of the vertical height of the bag. The band has a minimum vertical height of about 12 inches and preferably a vertical height of about 18 inches. The bottom edge of the band is located closely adjacent the bottom of the bag, usually in the lower one-fifth of the height of the bag and preferably within 8 inches of the bottom of the bag.

Preferably, the strength of the flexible material of the bag is insufficient for the bag without the band and when full to be dropped 6 feet without bursting. Typically, the strength of the flexible material of the band is no greater than and usually less than that of the bag. If desired to provide an increased burst strength to weight ratio, the band and/or bag can be made from circular woven fabric which is circumferentially continuous and does not have any longitudinal seams.

The following examples illustrate that a reinforced bulk bag of the present invention meets the requirements of the United States Department of Transportation, is rugged, durable and suitable for the transportation of hazardous wastes.

EXAMPLE I

Reinforced bulk bags having a height of about 40 inches and a width of each side of about 36 inches, were constructed in accordance with U.S. Pat. No. 4,596,040 from a flat coated sheet of 8 ounce per square yard fabric of woven polypropylene, and having a safety band which encircles the exterior of the bulk bag. The safety band extended from the bottom of the bag, had a height of 18 inches, and was constructed from 6.25 ounce per square yard fabric of circular woven polypropylene. Each of the reinforced bulk bags was filled with 2,200 pounds of material and its spouts closed prior to conducting each of the following tests.

Filled reinforced bulk bags were dropped from a height of at least 6 feet onto a concrete floor and the bulk bag and its contents remained entirely intact and without any damage to the bag.

A jerk test was successfully completed wherein a filled reinforced bulk bag was dropped a distance of 16 inches from its starting point and caught by its four slings or carrying straps with the bag and its contents remaining entirely intact and without any damage to the bag or its slings.

Filled reinforced bulk bags were toppled from a height of 4 feet onto a concrete floor and righted using only one sling or strap with the bags and their contents remaining entirely intact and without any damage to the bags or the slings.

Filled reinforced bulk bags were dragged by one strap a distance of 20 feet on a concrete floor at 3 miles per hour with the bag and its contents remaining entirely intact and without any damage to the bags or the slings.

EXAMPLE II

Reinforced bulk bags were made which were the same as the bags of Example I except that 6.25 ounce uncoated circular woven fabric of polypropylene was used to form the bags. These bags were filled with 2,200 pounds of material and subjected to all of the same tests of Example I, which were successfully completed. Moreover, one of these bags completed four successive drop tests, each from a height of 6 feet onto a concrete floor. This bag and its contents remained entirely intact and without any damage to the bag.

EXAMPLE III

A bulk bag was constructed in accordance with U.S. Pat. No. 4,596,040 from 9 ounce uncoated circular woven fabric of polypropylene and without a safety band. The bag was filled with 2,200 pounds of material and dropped from a height of 6 feet onto a concrete floor. As a result, the bag split open and its contents were lost.

From the above, it is readily appreciated that the reinforced bulk bag of the present invention is particularly suitable for transportation of hazardous waste, may be dropped from a height of 6 feet without damage to the bag or loss of its contents, can be made of relatively lightweight and flexible material, has a high strength-to-weight ratio, and is of relatively simple design, extremely rugged, durable and of economical manufacture and assembly.

I claim:

1. A reinforced bulk bag comprising a collapsible container having a bottom and a sidewall of a flexible material, a separate band of a flexible material, one of said band and sidewall encircling the other such that the sidewall is reinforced, said band having a minimum height equal to at least about one-fifth of the height of said sidewall of said container and a maximum height of about one half the height of said sidewall when said container is full, the lower edge of said band being located closely adjacent the bottom of the container, and wherein said band and sidewall are tacked together in at least two circumferentially spaced apart locations.

2. The reinforced bulk bag of claim 1 wherein the lower edge of said band is located in the lower one-fifth of the height of the sidewall of said container.

3. The reinforced bulk bag of claim 1 wherein said sidewall and band are tacked together by one of stitches, rivets, and staples.

4. The reinforced bulk bag of claim 1 wherein said band is formed from one of a fabric and plastic material.

5. The reinforced bulk bag of claim 4 wherein said band is formed from one of a woven polypropylene and polyethylene material.

6. The reinforced bulk bag of claim 4 wherein said band has a height ranging from about one-third to about one-half of the height of the sidewall of said container.

7. The reinforced bulk bag of claim 1 wherein said sidewall has a pair of overlying panels and a pair of gusset panels each with a central fold, said band being disposed outside of and encircling said sidewall, and said gusset panels and band are tacked together closely adjacent the fold of each of said gusset panels.

8. The reinforced bulk bag of claim 7 wherein said band is formed by a strip of material having two ends which are lapped and secured together and located over one of the overlying panels of said container.

9. The reinforced bulk bag of claim 8 wherein said band is tacked to said bag such that said overlapped ends are in a spaced apart relationship to any seam in the container.

10. The reinforced bulk bag of claim 1 wherein said sidewall has a pair of overlying panels and a pair of folding gusset panels, said band is disposed inside said container, and said sidewall and band are tacked together closely adjacent the side edges of said overlying panels.

11. The reinforced bulk bag of claim 1 wherein the flexible material of said container has insufficient strength for the container without the band and full to be dropped 6 feet without bursting.

12. The reinforced bulk bag of claim 11 wherein the strength of the flexible material of said band is not greater than the strength of the flexible material of said container.

13. The reinforced bulk bag of claim 1 wherein the strength of the flexible material of said band is not greater than the strength of the flexible material of the container.

14. The reinforced bulk bag of claim 1 wherein said band has a pair of ends and is connected together adjacent said ends, said sidewall of said container has a seam therein, and said seam and connection of said band are in spaced apart relationship.

15. The reinforced bulk bag of claim 1 wherein said band is of a circular woven fabric.

16. The reinforced bulk bag of claim 1 wherein said bag is of circular woven fabric.

17. The reinforced bulk bag of claim 16 wherein said band is of circular woven fabric.

18. A reinforced bulk bag comprising a collapsible container having a bottom and a sidewall of a flexible material, a separate band of a flexible material, one of said band and sidewall encircling the other such that the sidewall is reinforced, said band having a minimum height equal to at least about one-fifth of the height of said sidewall of said container and a maximum height of about one half the height of said sidewall when said container is full, the lower edge of said band being located closely adjacent the bottom of the container, said band and sidewall being tacked together, and the flexible material of said container has insufficient strength for the container without the band and full to be dropped 6 feet onto a fixed surface without bursting.

* * * * *